US011850696B2

(12) United States Patent
Sekiya

(10) Patent No.: US 11,850,696 B2
(45) Date of Patent: Dec. 26, 2023

(54) DRESSING BOARD, USE METHOD OF DRESSING BOARD, AND CUTTING APPARATUS

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/943,747

(22) Filed: Sep. 13, 2022

(65) Prior Publication Data

US 2023/0001536 A1 Jan. 5, 2023

Related U.S. Application Data

(62) Division of application No. 16/101,792, filed on Aug. 13, 2018, now abandoned.

(30) Foreign Application Priority Data

Aug. 22, 2017 (JP) ..... 2017-159529

(51) Int. Cl.

| | |
|---|---|
| ***B24B 27/06*** | (2006.01) |
| ***B24B 53/00*** | (2006.01) |
| ***B24B 53/12*** | (2006.01) |
| ***B24B 49/08*** | (2006.01) |
| ***B24B 49/18*** | (2006.01) |

(52) U.S. Cl.

CPC ..... *B24B 27/0683* (2013.01); *B24B 27/0608* (2013.01); *B24B 49/186* (2013.01); *B24B 53/003* (2013.01); *B24B 53/12* (2013.01)

(58) Field of Classification Search

CPC ..... B24B 49/00; B24B 49/12; B24B 49/18; B24B 49/186; B24B 27/0608; B24B 27/0683; B24B 53/04; B24B 51/00; B24B 53/003; B24B 53/12; B28D 7/005; G05B 2219/49304; G05B 2219/49305

USPC ..... 451/5, 6, 8, 21, 56, 443

See application file for complete search history.

(56) References Cited

U.S. PATENT DOCUMENTS

| | | | | |
|---|---|---|---|---|
| 6,264,533 | B1 * | 7/2001 | Kummeth | B24D 11/00 451/296 |
| 8,944,315 | B2 | 2/2015 | Schneider | |
| 2001/0000501 | A1 * | 4/2001 | Shinoda | H01J 9/00 451/6 |
| 2003/0040260 | A1 | 2/2003 | Andres | |

(Continued)

FOREIGN PATENT DOCUMENTS

| | | | |
|---|---|---|---|
| JP | 2006218571 | A | 8/2006 |
| JP | 2011011280 | A | 1/2011 |

(Continued)

*Primary Examiner* — Brian D Keller
*Assistant Examiner* — Marcel T Dion
(74) *Attorney, Agent, or Firm* — GREER BURNS & CRAIN, LTD.

(57) ABSTRACT

A dressing board having, on a surface, a two-dimensional code including information relating to properties of the dressing board and a barcode including identification information associated with the information relating to the properties is provided. Furthermore, there is provided a cutting apparatus including a determining part that determines whether or not the properties of the dressing board read out from an information registration part based on the identification information match the kind of dressing board suitable for dressing of a cutting blade.

3 Claims, 6 Drawing Sheets

(56) References Cited

U.S. PATENT DOCUMENTS

| | | | |
|---|---|---|---|
| 2013/0273815 | A1 | 10/2013 | Schneider |
| 2020/0023483 | A1 | 1/2020 | Beranek et al. |
| 2020/0094374 | A1 | 3/2020 | Beaucamp |
| 2020/0306927 | A1 | 10/2020 | Tanikella et al. |

FOREIGN PATENT DOCUMENTS

| | | | |
|---|---|---|---|
| JP | 2011016175 | A | 1/2011 |
| JP | 2012066328 | A | 4/2012 |
| JP | 2013229440 | A | 11/2013 |

* cited by examiner

DRESSING BOARD, USE METHOD OF DRESSING BOARD, AND CUTTING APPARATUS

This application is a divisional of application Ser. No. 16/101,792, filed Aug. 13, 2018.

BACKGROUND OF THE INVENTION

Field of the Invention

The present invention relates to a dressing board used when dressing of a cutting blade is carried out, a use method of a dressing board, and a cutting apparatus including a cutting unit.

Description of the Related Art

In a manufacturing process of device chips, planned dividing lines in a lattice manner called streets are set on surfaces of wafers and devices are formed in the respective regions marked out by the planned dividing lines. When these wafers are cut along the planned dividing lines, individual device chips are formed. Among the wafers are wafer for semiconductor devices formed of silicon, gallium arsenide, or the like, wafer for optical devices formed of SiC (silicon carbide) or the like, package substrate including resin and metal, ceramic substrate, glass substrate, and so forth.

The cutting is carried out by a cutting apparatus having a cutting unit including a cutting blade having a circular ring shape for example. The cutting unit has a spindle that serves as the axis of rotation and has a circular column shape and the cutting blade is mounted to the tip of the spindle. As the cutting blade, a proper cutting blade is selected depending on the type of workpiece and the contents of processing. The cutting blade is rotated by rotating the spindle, and a workpiece is cut when the rotating cutting blade is brought into contact with the workpiece. The cutting blade has a cutting abrasive containing abrasive grains and a bond material that holds the abrasive grains. In the state in which the abrasive grains are moderately exposed from the bond material, the abrasive grains get contact with a workpiece and thus the workpiece can be properly cut. However, in the case of an unused cutting blade or a cutting blade that has been worn and be lowered in the cutting capability, the abrasive grains are buried in the bond material or dropping-off of the abrasive grains from the bond material, or the like, has occurred, and the cutting blade is not in the state in which proper cutting can be carried out in many cases. Thus, the cutting blade is adjusted by processing called dressing. The dressing is carried out by causing a cutting blade to cut a dressing board. When cutting the dressing board, the cutting blade is properly worn and the abrasive grains are moderately exposed from the bond material.

Furthermore, when an unused cutting blade is mounted to the cutting unit, the distance from the rotation axis to the outer circumference of the cutting blade is not uniform in the whole circumference in some cases. When such a cutting blade is subjected to dressing, the part at which the distance from the rotation axis is longer is worn intensely compared with the part at which the distance from the rotation axis is shorter and the distance from the rotation axis to the outer circumference becomes uniform in the whole circumference, so that the cutting blade becomes the state in which proper cutting can be carried out. As above, the dressing of the cutting blade is carried out for the purposes of moderately exposing the abrasive grains from the bond material (referred to also as blade sharpening) and making the distance from the rotation axis to the outer circumference uniform (referred to also as roundness generation). Various kinds of dressing boards exist and the proper kind of dressing board is used according to the kind of cutting blade and the purpose of dressing. In order to carry out dressing properly and efficiently, a wide variety of dressing boards and cutting apparatuses have been developed (refer to Japanese Patent Laid-Open Nos. 2006-218571, 2011-11280, and 2011-16175).

If an improper kind of dressing board is accidentally used when dressing of a cutting blade is carried out, breaking occurs in the cutting blade or the state of blade sharpening deteriorates in some cases. Thus, in order to prevent erroneous use of the dressing board, a technique in which a barcode (one-dimensional code) in which information relating to a dressing board is stored is printed on a surface of the dressing board has been proposed (Japanese Patent Laid-Open No. 2012-66328). When the dressing board is used, the barcode is read and the information is checked by a cutting apparatus.

SUMMARY OF THE INVENTION

However, the amount of information that can be stored in the barcode is small and the information that can be stored in the barcode and relates to the dressing board is limited. Thus, it is conceivable that a two-dimensional code, with which the amount of information that can be stored is comparatively large, is disposed on the dressing board instead of the barcode. When the whole surface of the dressing board is employed as the region that can be cut for dressing thoroughly, the dressing board can be efficiently used. However, when the region in which the two-dimensional code is disposed is cut by a cutting blade even partly, the two-dimensional code becomes unreadable. For this reason, when use of the dressing board is suspended once and the dressing board is removed from a cutting apparatus and thereafter using the dressing board again is attempted, it is impossible to check the information relating to the dressing board from the two-dimensional code in some cases.

The present invention is made in view of these problems and an object thereof is to provide a dressing board that allows acquisition of information relating to the dressing board even when being cut by a cutting blade, a use method of the dressing board, and a cutting apparatus.

In accordance with an aspect of the present invention, there is provided a dressing board used when dressing of a cutting blade is carried out. The dressing board includes a two-dimensional code that is disposed on a surface of the dressing board and includes information relating to properties of the dressing board and a barcode that is disposed on the surface of the dressing board and includes identification information associated with the information relating to the properties.

Preferably, the information relating to the properties includes information relating to abrasive grains of the dressing board, a bond material of the dressing board, the size of the dressing board, or a product type of the cutting blade that corresponds.

Furthermore, in accordance with another aspect of the present invention, there is provided a use method of a dressing board having, on a surface, a two-dimensional code including information relating to properties of the dressing board and a barcode including identification information associated with the information relating to the properties. A cutting apparatus is used in the use method. The cutting apparatus includes a chuck table that holds a workpiece, a cutting unit that cuts the workpiece held by the chuck table by a cutting blade, a control unit that includes an information registration part and controls each constituent element, and an imaging unit connected to the control unit. The use method includes a dressing board disposing step of disposing the dressing board in the cutting apparatus, an identification information reading step of imaging the barcode of the dressing board disposed in the disposing step by the imaging unit and reading the identification information from the barcode, and an information registration step of determining whether or not the identification information has been already registered in the information registration part and, if the identification information has not been registered in the information registration part, reading the information relating to the properties from the two-dimensional code to register the information relating to the properties in the information registration part in association with the identification information.

In addition, in accordance with another aspect of the present invention, there is provided a use method of a dressing board having, on a surface, a two-dimensional code including information relating to properties of the dressing board and a barcode including identification information associated with the information relating to the properties. A cutting apparatus is used in the use method. The cutting apparatus includes a chuck table that holds a workpiece, a cutting unit that cuts the workpiece held by the chuck table by a cutting blade, a control unit that controls each constituent element, and an imaging unit connected to the control unit. The control unit includes an information registration part in which the identification information included in the barcode possessed by the dressing board and the information relating to the properties, included in the two-dimensional code, are registered in association with each other in advance and a specifying part in which a kind of dressing board suitable for dressing of the cutting blade is registered. The use method includes a dressing board disposing step of disposing the dressing board in the cutting apparatus, an identification information reading step of imaging the barcode of the dressing board disposed in the disposing step by the imaging unit and reading the identification information from the barcode, a determination step of reading out, from the information registration part, the information relating to the properties associated with the identification information read in the identification information reading step and determining whether or not the properties of the dressing board included in the information relating to the properties match the kind of dressing board suitable for dressing of the cutting blade, registered in the specifying part, and an informing step of informing that the dressing board is improper if the properties of the dressing board do not match the kind of dressing board suitable for dressing of the cutting blade.

Moreover, in accordance with another aspect of the present invention, there is provided a cutting apparatus including a chuck table that holds a workpiece, a first cutting unit that cuts the workpiece held by the chuck table by a first cutting blade, a control unit that controls each constituent element, and an imaging unit connected to the control unit. The control unit includes a reading part that is connected to the imaging unit and reads a barcode and a two-dimensional code that are possessed by a dressing board disposed in the cutting apparatus, an information registration part in which identification information read from the barcode by the reading part and information relating to properties of the dressing board, read from the two-dimensional code, are registered in association with each other, a specifying part in which a kind of dressing board suitable for dressing of the first cutting blade is registered, and a determining part that determines whether or not the properties of the dressing board included in the information relating to the properties read out from the information registration part based on the identification information read by the reading part match the kind of dressing board suitable for dressing of the first cutting blade, registered in the specifying part.

Preferably, the cutting apparatus includes a first dress table that holds the dressing board. Furthermore, the cutting apparatus further includes a second cutting unit that cuts the workpiece held by the chuck table by a second cutting blade and a second dress table that holds a second dressing board used when dressing of the second cutting blade is carried out.

For the dressing board according to one aspect of the present invention, the two-dimensional code including the information relating to the properties of the dressing board and the barcode including the identification information associated with the information relating to the properties are disposed on the surface. Thus, by imaging the dressing board by the imaging unit or the like, the identification information can be acquired from the barcode and the information relating to the properties can be acquired from the two-dimensional code. In the control unit of the cutting apparatus according to one aspect of the present invention, the information relating to the properties can be registered in association with the identification information.

When dressing by use of the dressing board is carried out and the two-dimensional code printed on the dressing board is cut even partly, it becomes impossible to read the information relating to the properties from the two-dimensional code. Thus, the two-dimensional code cannot be read in some cases although reading the two-dimensional code is attempted when the dressing board is used again after being removed from the cutting apparatus once. However, the identification information can be read from the barcode left on the surface between two adjacent cut grooves among cut grooves formed due to the cutting. For this reason, if the information relating to the properties stored in the two-dimensional code is registered in the cutting apparatus in association with the identification information in advance, the information relating to the properties can be extracted from the identification information.

As above, a dressing board that allows acquisition of information relating to the dressing board even when being cut by a cutting blade, a use method of the dressing board, and a cutting apparatus are provided by the present invention.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

An embodiment relating to one aspect of the present invention will be described with reference to the accompanying drawings. The embodiment of the present invention is a dressing board, a use method of a dressing board, and a cutting apparatus.

Figure 1:
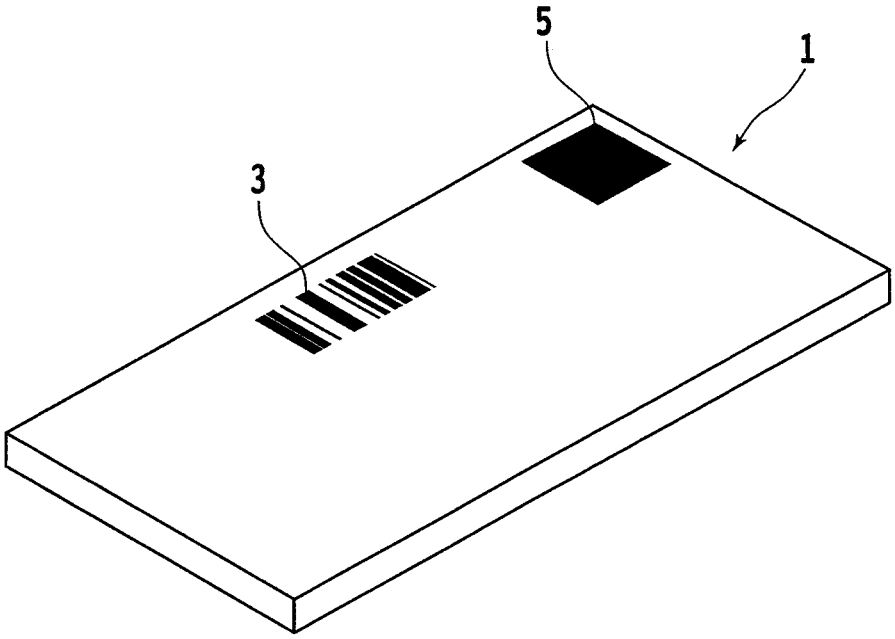
FIG. 1 is a perspective view schematically depicting a dressing board.

FIG. 1 is a perspective view schematically depicting the dressing board according to the present embodiment. As depicted in FIG. 1, a barcode 3 and a two-dimensional code 5 are disposed on a surface of a dressing board 1. The dressing board 1 is used for dressing of a cutting blade mounted to a cutting apparatus. The cutting blade has a cutting abrasive containing abrasive grains and a bond material (binging material) that holds the abrasive grains. In the state in which the abrasive grains are moderately exposed from the bond material, the abrasive grains can get contact with a workpiece and thus the workpiece can be properly cut. However, in the case of an unused cutting blade or a cutting blade that has been worn and be lowered in the cutting capability, the abrasive grains are buried in the bond material or dropping-off of the abrasive grains from the bond material, or the like, has occurred, and the cutting blade is not in the state in which proper cutting can be carried out in many cases. Thus, the cutting blade is adjusted by processing called dressing in which the cutting blade is caused to cut the dressing board. When cutting the dressing board, the cutting blade is properly worn and the abrasive grains are moderately exposed from the bond material, which provides the state in which proper cutting can be carried out.

Furthermore, when an unused cutting blade is mounted to a cutting unit, the distance from the rotation axis to the outer circumference of the cutting blade is not uniform in the whole circumference in some cases. When such a cutting blade is subjected to dressing, the part at which the distance from the rotation axis is comparatively longer is worn more intensely relative to the part at which the distance from the rotation axis is comparatively shorter and the distance from the rotation axis to the outer circumference becomes uniform in the whole circumference, so that the cutting blade becomes the state in which proper cutting can be carried out.

As above, the dressing of the cutting blade is carried out for the purposes of moderately exposing the abrasive grains from the bond material (referred to also as blade sharpening) and making the distance from the rotation axis to the outer circumference uniform (referred to also as roundness generation). The dressing board also contains a bond material and abrasive grains. Various kinds of dressing boards exist and the proper kind of dressing board is used according to the kind of cutting blade as the target of dressing and the purpose of dressing.

For example, the bond material is resin, ceramics, or the like and the abrasive grains are green carborundum, white alundum, or the like. The size of the abrasive grains is typically #200 to #2000. For a cutting blade in which the bond material is hard or a cutting blade in which the abrasive grains are large, a dressing board in which the bond material is hard or a dressing board in which the abrasive grains are large is used. Furthermore, for a cutting blade in which the bond material is soft or a cutting blade in which the abrasive grains are small, a dressing board in which the bond material is soft or a dressing board in which the abrasive grains are small is used.

On the dressing board 1 according to the present embodiment, the barcode 3 and the two-dimensional code 5 are disposed. Identification information of the dressing board 1 is stored in the barcode 3. The identification information is a unique number such as a manufacturing number of the dressing board 1 for example. Generally the amount of information that can be stored in the barcode is comparatively small and it is impossible to store all of information relating to properties of the dressing board. Thus, on the dressing board 1, the two-dimensional code 5 in which information relating to properties of the dressing board 1 is stored is disposed. The information stored in the two-dimensional code 5 is product number, manufacturing number, manufacturing date, expiration date, size (vertical and horizontal lengths, thickness) of the dressing board 1, the kinds of bond (binding material) and abrasive grains contained in the dressing board 1, and so forth (see FIG. 6). Furthermore, information relating to the kind of cutting blade suitable for dressing with the dressing board 1 may be stored.

Figure 2:
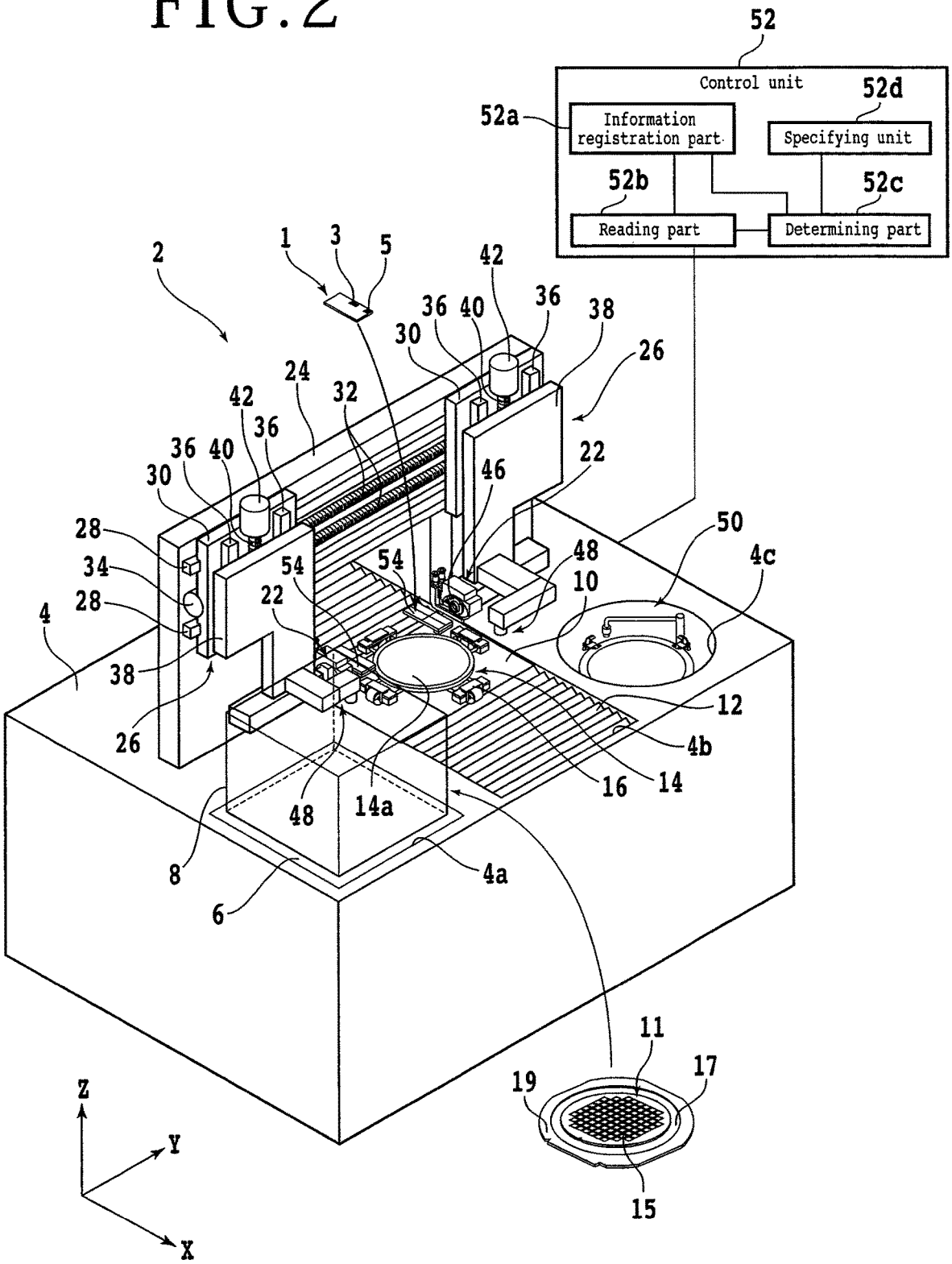
FIG. 2 is a perspective view schematically depicting a cutting apparatus.

Next, the cutting apparatus according to the present embodiment in which the dressing board 1 is used will be described. FIG. 2 is a perspective view schematically depicting the cutting apparatus 2. As depicted in FIG. 2, the cutting apparatus 2 includes a base 4 that supports the respective structures. A rectangular opening 4*a* is formed at a corner part on the front side of the base 4 and a cassette support base 6 that ascends and descends is provided in the opening 4*a*. A cassette 8 that houses plural workpieces 11 is placed on the upper surface of the cassette support base 6. In FIG. 2, only the contour of the cassette 8 is depicted for convenience of explanation.

The workpiece 11 is a circular wafer composed of a semiconductor material such as silicon for example and the front surface side thereof is divided into a device region at the center and a peripheral surplus region surrounding the device region. The device region 15 is further segmented into plural regions by planned dividing lines (streets) arranged in a lattice manner and a device such as integrated circuit (IC) or large scale integration (LSI) is formed in each region. A dicing tape 17 with a diameter larger than the workpiece 11 is stuck to the back surface side of the workpiece 11. The peripheral part of the dicing tape 17 is fixed to a ring-shaped frame 19. That is, the workpiece 11 is supported by the frame 19 with the intermediary of the dicing tape 17. Although a circular wafer composed of a semiconductor material such as silicon is employed as the workpiece 11 in the present embodiment, there is no limit on the material, shape, structure, and so forth of the workpiece 11. For example, it is also possible to use a rectangular substrate composed of a material such as ceramics, resin, or metal as the workpiece 11. There is no limit also on the kind, number, arrangement, and so forth of the devices.

An opening 4*b* having a rectangular shape long in an X-axis direction (front-rear direction, processing-feed direction) is formed on a lateral side of the cassette support base 6. In the opening 4*b*, an X-axis movement table 10, an X-axis movement mechanism (not depicted) that moves the X-axis movement table 10 in the X-axis direction, and a dust-proof, splash-proof cover 12 that covers the X-axis movement mechanism are provided. The X-axis movement mechanism includes a pair of X-axis guide rails (not depicted) parallel to the X-axis direction and the X-axis movement table 10 is slidably attached to the X-axis guide rails. A nut part (not depicted) is provided on the lower surface side of the X-axis movement table 10 and an X-axis ball screw (not depicted) parallel to the X-axis guide rails is screwed to this nut part. An X-axis pulse motor (not depicted) is joined to one end part of the X-axis ball screw. The X-axis ball screw is rotated by the X-axis pulse motor and thereby the X-axis movement table 10 moves in the X-axis direction along the X-axis guide rails.

A chuck table 14 for holding the workpiece 11 is provided above the X-axis movement table 10. Around the chuck table 14, four clamps 16 for fixing the ring-shaped frame 19 that supports the workpiece 11 from four sides are disposed. The chuck table 14 is joined to a rotation drive source (not depicted) such as a motor and rotates around a rotation axis substantially parallel to a Z-axis direction (vertical direction). Furthermore, processing feed of the chuck table 14 is carried out in the X-axis direction by the above-described X-axis movement mechanism. The upper surface of the chuck table 14 serves as a holding surface 14*a* that holds the workpiece 11. The holding surface 14*a* is connected to a suction source (not depicted) through a suction path and so forth formed inside the chuck table 14.

A conveying unit (not depicted) that conveys the above-described workpiece 11 to the chuck table 14 is provided at a position near the opening 4*b*. The workpiece 11 conveyed to the conveying unit is placed on the holding surface 14*a* of the chuck table 14 in such a manner that the front surface side is exposed upward for example. On the upper surface of the base 4, a gate-shaped support structure 24 for supporting two sets of cutting units 22 is disposed to straddle the opening 4*b*. At the upper part of the front surface of the support structure 24, two sets of cutting unit movement mechanisms 26 that move the respective cutting units 22 in a Y-axis direction (right-left direction, indexing-feed direction) and the Z-axis direction are provided.

The respective cutting unit movement mechanisms 26 include, in common, a pair of Y-axis guide rails 28 that are disposed on the front surface of the support structure 24 and are parallel to the Y-axis direction. Y-axis movement plates 30 that form the respective cutting unit movement mechanisms 26 are slidably attached to the Y-axis guide rails 28. A nut part (not depicted) is provided on the back surface side (rear surface side) of each Y-axis movement plate 30 and Y-axis ball screws 32 parallel to the Y-axis guide rails 28 are each screwed to this nut part. A Y-axis pulse motor 34 is joined to one end part of each Y-axis ball screw 32. When the Y-axis ball screw 32 is rotated by the Y-axis pulse motor 34, the Y-axis movement plate 30 moves in the Y-axis direction along the Y-axis guide rails 28.

A pair of Z-axis guide rails 36 parallel to the Z-axis direction are provided on a surface (front surface) of each Y-axis movement plate 30. Z-axis movement plates 38 are slidably attached to the Z-axis guide rails 36. A nut part (not depicted) is provided on the back surface side (rear surface side) of each Z-axis movement plate 38 and Z-axis ball screws 40 parallel to the Z-axis guide rails 36 are each screwed to this nut part. A Z-axis pulse motor 42 is joined to one end part of each Z-axis ball screw 40. When the Z-axis ball screw 40 is rotated by the Z-axis pulse motor 42, the Z-axis movement plate 38 moves in the Z-axis direction along the Z-axis guide rails 36.

The cutting unit 22 is provided at the lower part of each Z-axis movement plate 38. The cutting unit 22 includes a circular-ring-shaped cutting blade 46 (see FIG. 3 and FIG. 5A) mounted to one end side of a spindle 44 (see FIG. 5A) serving as a rotation axis. Furthermore, imaging cameras (imaging units) 48 that image the workpiece 11 and so forth are provided at positions adjacent to the cutting units 22. When the Y-axis movement plates 30 are moved in the Y-axis direction by the respective cutting unit movement mechanisms 26, indexing feed of the cutting units 22 and the imaging cameras 48 is carried out in the Y-axis direction. Furthermore, when the Z-axis movement plates 38 are moved in the Z-axis direction by the respective cutting unit movement mechanisms 26, the cutting units 22 and the imaging cameras 48 ascend or descend. A circular opening 4*c* is formed at a position on the opposite side to the opening 4*a* across the opening 4*b*. In the opening 4*c*, a cleaning unit 50 for cleaning the workpiece 11 and so forth after cutting is provided. A control unit (control means) 52 is connected to constituent elements such as the X-axis movement mechanism, the chuck table 14, the cutting units 22, the cutting unit movement mechanisms 26, the imaging cameras 48, and the cleaning unit 50. Each constituent element is controlled by this control unit (control means) 52.

Figure 3:
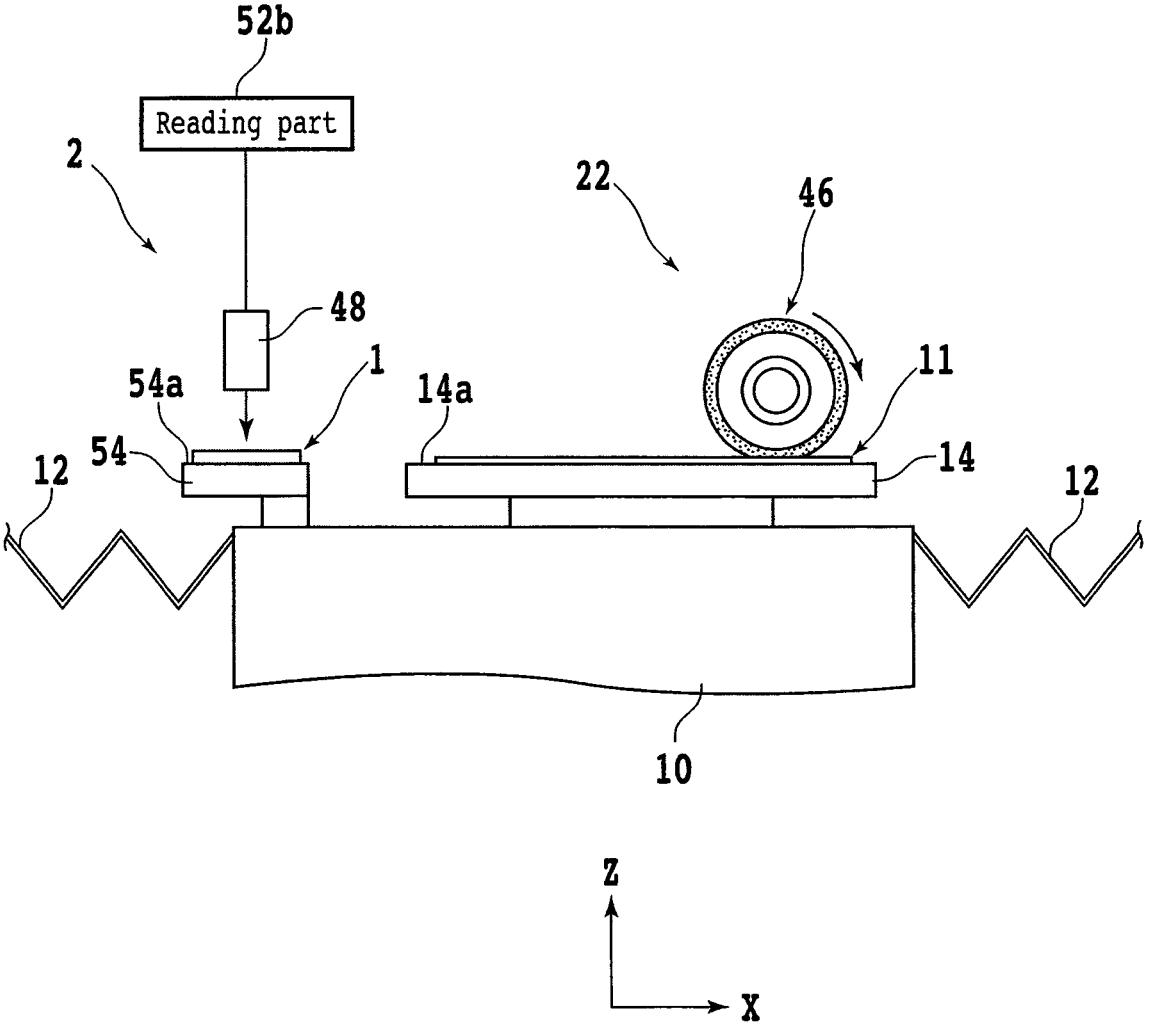
FIG. 3 is a side view for explaining the positional relationship among a cutting unit, a chuck table, a dress table, and an imaging camera of the cutting apparatus.

Furthermore, two dress tables 54 are provided over the X-axis movement table 10 of the cutting apparatus 2 according to the present embodiment. FIG. 3 is a side view for explaining the positional relationship among the cutting unit 22, the chuck table 14, the dress table 54, and the imaging camera 48 of the cutting apparatus 2. In FIG. 3, the imaging camera 48 in the state of being positioned at a position to image the dressing board 1 and the cutting blade 46 in the state of being positioned at a position to carry out cutting processing of the workpiece 11 are simultaneously depicted. However, because of the configuration of the cutting apparatus 2 depicted in FIG. 1, it is impossible to simultaneously position, individually, the imaging camera 48 and the cutting blade 46 in this manner. In FIG. 3, they are each represented in the state of being positioned in this manner for convenience of explanation.

As depicted in FIG. 3, the dress table 54 is disposed on the rear end side of the chuck table 14 of the X-axis movement table 10. The dress table 54 is fixed to the upper surface of the rear end side of the X-axis movement table 10. The upper surface of the dress table 54 is a holding surface 54*a* that holds the dressing board 1. For example, a suction groove having a cross shape in plan view is formed in the holding surface 54*a* and a suction hole is formed at the center of the cross. The suction hole leads to a suction source, which is not depicted in the diagram, through a suction path (not depicted) inside the dress table 54. When the suction source is actuated in the state in which the dressing board 1 is placed on the holding surface 54*a* of the dress table 54, the dressing board 1 is held on the holding surface 54*a* by suction.

Dressing of the cutting blade 46 may be carried out over the chuck table 14, with the dressing board 1 held on the holding surface 14*a* of the chuck table 14. In this case, when cutting processing of the workpiece 11 is carried out, the dressing board 1 held by the chuck table 14 needs to be removed and the workpiece 11 needs to be held instead. Furthermore, the dress table 54 is disposed on the rear end side of the chuck table 14 of the X-axis movement table 10. If the dress table 54 is disposed on the front end side of the chuck table 14, cutting chips generated from the dressing board 1 are scattered onto the chuck table 14 and the chuck table 14 is polluted.

The imaging camera 48 is used to check a key pattern or planned cutting line used when the workpiece 11 is imaged and the position of cutting is figured out in cutting processing of the workpiece 11 held by the chuck table 14. Furthermore, the imaging camera 48 can move to a position above the dress table 54 and image the dressing board 1 held by the holding surface 54*a*. Image data obtained by the imaging is sent to a reading part 52*b* of the control unit 52 of the cutting apparatus 2.

Next, constituent elements of the control unit 52 of the cutting apparatus 2 will be described by using FIG. 2 and the respective functions thereof will be described. The control unit 52 is management apparatus of the cutting apparatus 2 for example and the respective constituent elements to be described below in the control unit 52 and functions thereof may be implemented as a program by the management apparatus.

The control unit 52 has the reading part 52*b* and the reading part 52*b* reads the barcode 3 and the two-dimensional code 5 that appear in a captured image received from the imaging camera 48. Then, the reading part 52*b* acquires the identification information of the dressing board 1 from the barcode 3 and acquires information relating to properties of the dressing board 1 from the two-dimensional code 5. The reading part 52*b* has a function of sending the acquired informations to an information registration part 52*a* and a determining part 52*c*. Furthermore, the reading part 52*b* has a function of sending, to the information registration part 52*a*, a signal indicating that the two-dimensional code 5 cannot be read to the information registration part 52*a* and the identification information acquired from the barcode 3 if the two-dimensional code 5 of the dressing board 1 cannot be read due to damage or the like. In the information registration part 52*a*, the identification information of the dressing board 1 and the information relating to the properties are registered in association with each other. The information registration part 52*a* has a function of sending the information relating to the properties associated with the identification information to the determining part 52*c* when receiving the signal indicating that the two-dimensional code 5 cannot be read and the identification information.

In a specifying part 52*d*, information relating to the kind of dressing board 1 suitable for dressing of the cutting blade 46 mounted to the cutting apparatus 2 is registered. The information is input by a worker whose has mounted the cutting blade 46 to the cutting apparatus 2 for example. The specifying part 52*d* has a function of sending the information to the determining part 52*c* in response to a request by the determining part 52*c*. In the specifying part 52*d*, information relating to the kinds of dressing board 1 suitable for dressing regarding various kinds of cutting blade 46 may be registered in advance. In this case, for example, the worker may register the kind of cutting blade 46 in the specifying part 52*d* in advance and the specifying part 52*d* may transmit information relating to the kind of dressing board suitable for dressing of the registered kind of cutting blade 46 to the determining part 52*c*. The determining part 52*c* has a function of determining whether or not the dressing board 1 disposed in the cutting apparatus 2 matches the kind of dressing board suitable for dressing of the cutting blade 46 mounted to the cutting apparatus 2. When receiving the information relating to the kind of dressing board 1, the determining part 52*c* obtains the information relating to the kind of dressing board suitable for dressing of the cutting blade 46 from the specifying part 52*d* and carries out the determination.

The cutting apparatus 2 may have a configuration in which dressing can be independently carried out for each of the first and second cutting blades 46 mounted to the two cutting units 22. For example, the cutting apparatus 2 may include a first dress table that holds the first dressing board 1 with which dressing of the first cutting blade 46 is carried out and a second dress table that holds the second dressing board 1 with which dressing of the second cutting blade 46 is carried out.

Figure 4A:
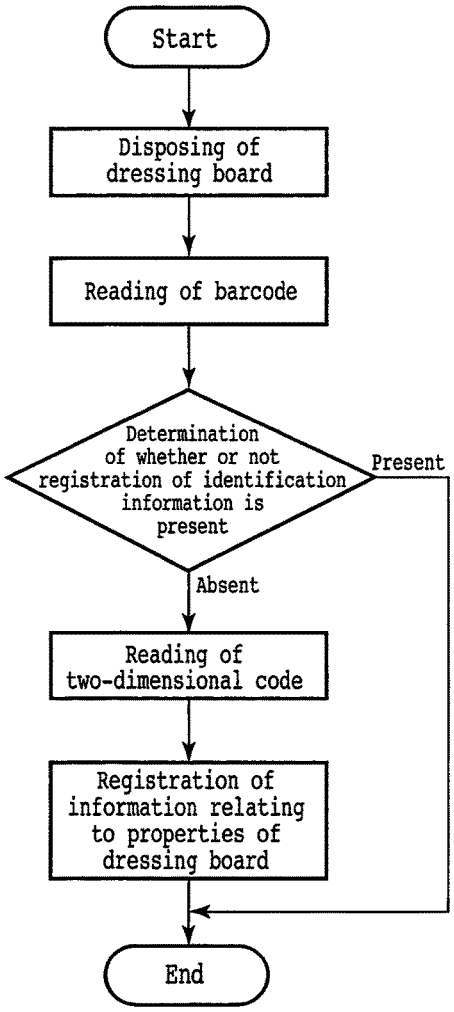
FIG. 4A is a flowchart for explaining a method in which identification information of the dressing board and information relating to properties are registered in an information registration part in association with each other.

Next, the use method of the dressing board 1 with use of the cutting apparatus 2 will be described. When the dressing board 1 is used, identification information and information relating to properties can be registered in the cutting apparatus 2 in association with each other. Furthermore, when the dressing board 1 is used, the information relating to the properties can be acquired from the identification information and whether or not dressing of a cutting blade is possible can be determined. First, a use method of the dressing board 1 in which the identification information and the information relating to the properties are registered in the control unit 52 of the cutting apparatus 2 in association with each other will be described. FIG. 4A is a flowchart for explaining the use method of the dressing board 1. In the use method, first a dressing board disposing step of disposing the dressing board 1 in the cutting apparatus 2 is carried out. The dressing board 1 is disposed on the dress table (see FIG. 2) of the cutting apparatus 2 or the chuck table 14 (see FIG. 2). Next, an identification information reading step of imaging the barcode 3 of the dressing board 1 by the imaging camera (imaging unit) 48 and reading the identification information from the barcode 3 is carried out. In the step, the dressing board 1 is positioned below the imaging camera 48 and the imaging camera 48 is caused to image the dressing board 1. The obtained captured image is sent to the reading part 52*b* of the control unit 52. In the reading part 52*b*, the identification information of the dressing board 1 is acquired from the barcode 3 that appears in the captured image.

Next, an information registration step of registering the information relating to the properties in the information registration part 52*a* in association with the identification information is carried out. In the information registration step, in order to prevent duplicate registration in the information registration part 52*a*, first it is determined whether or not the identification information acquired from the barcode 3 has been already registered in the information registration part 52*a*. If the identification information has not been registered in the information registration part 52*a*, the information relating to the properties is read from a two-dimensional code that appears in the captured image and the information relating to the properties of the dressing board 1 is registered in the information registration part 52*a* in association with the identification information. On the other hand, if the identification information has been registered in the information registration part 52*a*, the information on the dressing board 1 is not registered in the information registration part 52*a* because duplicate registration is unnecessary. By the above, regarding the dressing board 1 disposed in the cutting apparatus 2, the information relating to the properties can be registered in the cutting apparatus 2 in association with the identification information. The registration is automatically carried out by the cutting apparatus 2. Therefore, an operator or the like of the cutting apparatus 2 does not need input the information and the possibility of erroneous input also does not exist.

Figure 5A:
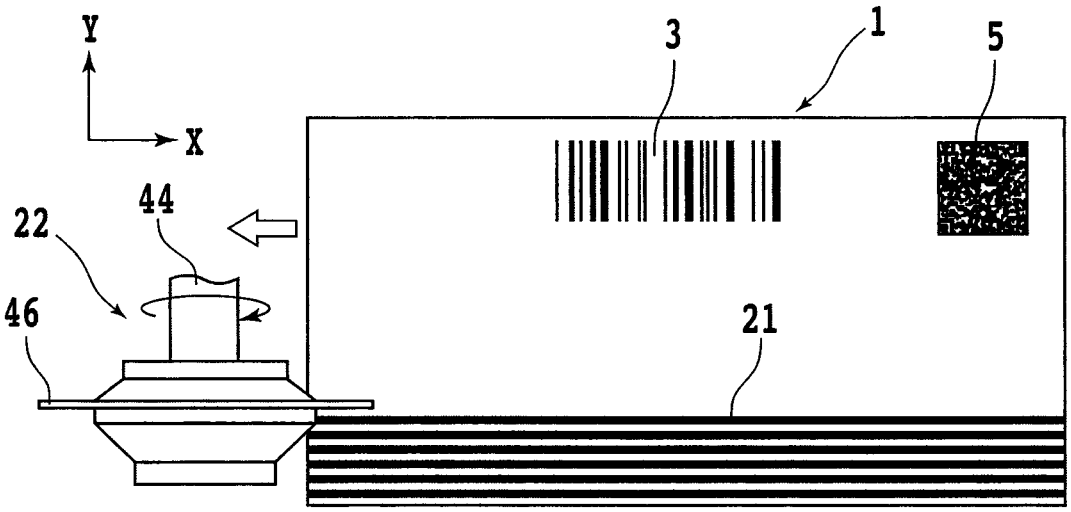
FIG. 5A is a top view schematically depicting dressing of the cutting blade by use of the dressing board.
Figure 5B:
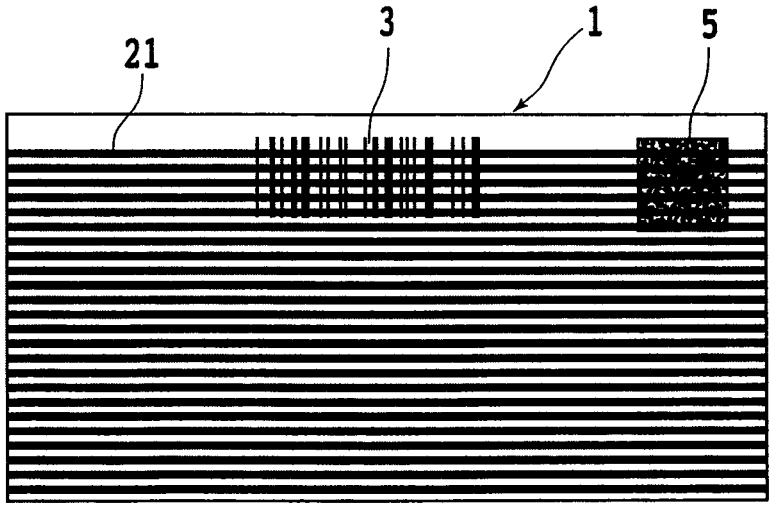
FIG. 5B is a top view schematically depicting the dressing board used for the dressing.

Next, dressing of the cutting blade 46 by use of the dressing board 1 will be described. FIG. 5A is a top view schematically depicting dressing of a cutting blade by use of a dressing board and FIG. 5B is a top view schematically depicting the dressing board used for the dressing. As depicted in FIG. 5A, the spindle 44 of the cutting unit 22 is rotated to rotate the cutting blade 46. Furthermore, the X-axis movement table 10 is moved along the X-axis direction and the cutting blade 46 is caused to cut into the dressing board 1. Thereupon, a cut groove 21 along the X-axis direction is formed in the dressing board 1. If the dressing of the cutting blade 46 is not completed even when the cut groove 21 is formed from one end of the dressing board 1 to the other end, the cutting blade 46 is shifted in the Y-axis direction and is caused to repeatedly cut the dressing board 1 until the dressing of the cutting blade 46 is completed.

To use the dressing board 1 efficiently and economically, it is preferable to cause the cutting blade 46 to cut the whole surface of the dressing board 1 thoroughly. However, if the region in which the two-dimensional code 5 is disposed is cut by the cutting blade 46 even partly, the two-dimensional code 5 becomes unreadable. For example, in the dressing board 1 depicted in FIG. 5B, the cut grooves 21 that overlap with the two-dimensional code 5 are formed and the two-dimensional code 5 is unreadable. In this case, when use of the dressing board 1 is suspended once and the dressing board 1 is removed from the cutting apparatus 2 and thereafter using the dressing board 1 again is attempted, it is impossible to acquire the information relating to the properties of the dressing board 1 from the two-dimensional code 2. However, even in such a case, the information relating to the properties can be acquired by a use method of the dressing board 1 to be described next because the information relating to the properties is registered in the cutting apparatus 2 in association with the identification information stored in the barcode 3. The use method can be carried out also when the two-dimensional code 5 is readable.

Figure 4B:
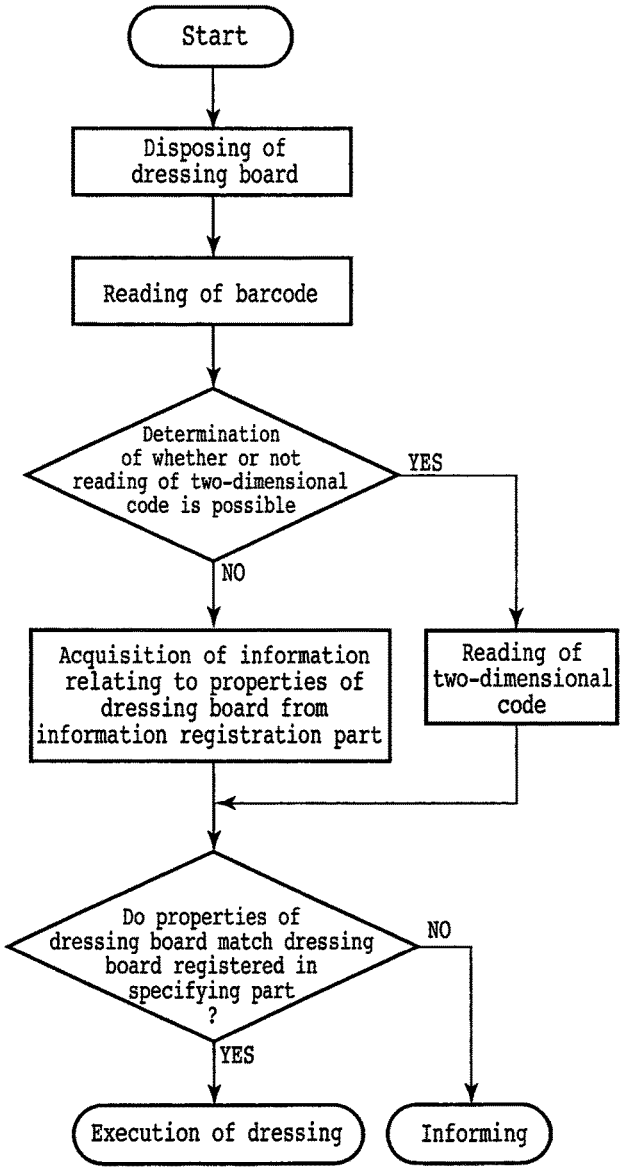
FIG. 4B is a flowchart for explaining a method in which it is determined whether or not the properties of the dressing board are suitable for dressing of a cutting blade.

The use method of the dressing board 1 in which information relating to properties of the dressing board 1 is acquired by using identification information read from the barcode 3 will be described. FIG. 4B is a flowchart for explaining the use method of the dressing board 1. First, similarly to the above-described use method explained with FIG. 4A, the dressing board disposing step of disposing the dressing board 1 in the cutting apparatus 2 and the identification information reading step of reading the identification information from the barcode 3 are carried out. Next, whether or not the two-dimensional code 5 of the dressing board 1 is readable is determined. If the two-dimensional code 5 can be read from a captured image acquired by the imaging camera 48, the information relating to the properties of the dressing board 1 is acquired from the two-dimensional code 5. On the other hand, if the two-dimensional code 5 cannot be read from the captured image, for example the barcode 3 left in the gap between two adjacent cut grooves 21 is read and the identification information is acquired as depicted in FIG. 5B. Then, reference to the information registration part 52*a* is made based on the identification information and the information relating to the properties associated with the identification information is acquired from the information registration part 52*a*.

After the barcode 3 is read and the identification information is acquired, the information relating to the properties associated with the identification information may be acquired from the information registration part 52*a* without determining whether or not the two-dimensional code 5 is readable. In this case, it is checked in advance whether or not the information relating to the properties associated with the identification information has been registered in the information registration part 52*a*, and the registered information is acquired if the registration can be confirmed. If the registration cannot be registered, the information relating to the properties is read from the two-dimensional code 5 and is registered in the information registration part 52*a* in association with the identification information. The barcode 3 becomes unreadable if the barcode 3 is cut along the longitudinal direction of each bar forming the barcode 3 and even one of the bars is lost. For this reason, the barcode 3 is disposed in such a manner that each bar does not extend along the extension direction of the cut grooves 21 formed through cutting of the dressing board 1.

Figure 6:
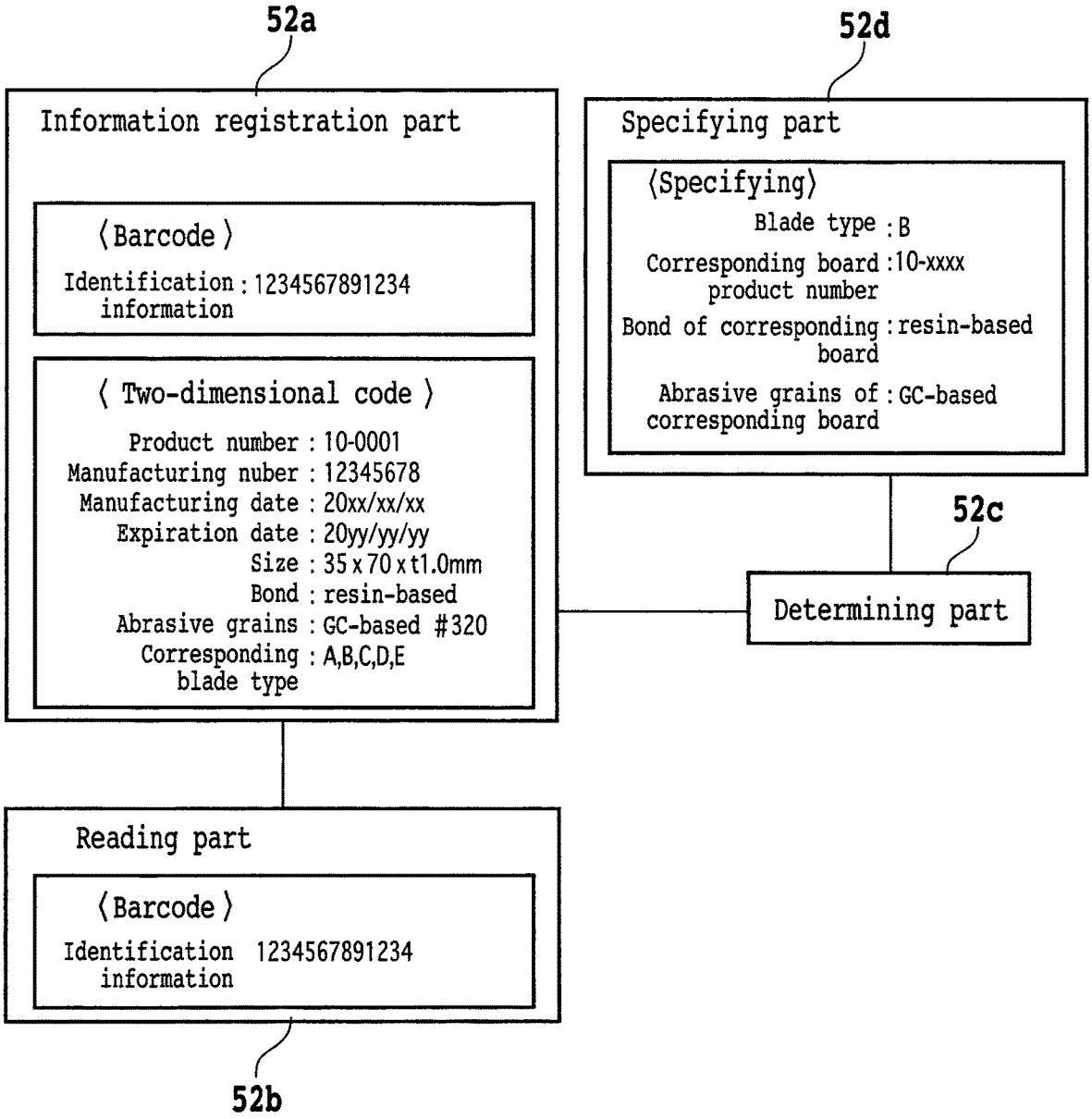
FIG. 6 is a block diagram for schematically explaining the configuration of a control unit and various kinds of information.

Next, it is determined whether or not the properties of the dressing board 1 included in the information relating to the properties match the kind of dressing board suitable for dressing of the cutting blade 46 registered in the specifying part 52*d* of the control unit 52. In FIG. 6, one example of each configuration of the control unit 52, the identification information of the dressing board 1 and the information relating to properties, and information relating to specifying of the dressing board 1 registered in the specifying part 52*d* is depicted. In the example depicted in FIG. 6, the case is depicted in which the two-dimensional code 5 is unreadable and the reading part 52*b* acquires the identification information from the barcode 3 and reference to the information registration part 52*a* is made based on the identification information and the determining part 52*c* acquires the information relating to the properties. In the specifying part 52*d*, information relating to the type of dressing board 1 suitable for dressing of the cutting blade 46 attached to the cutting apparatus 2 is registered in advance for example. Furthermore, the product number of the dressing board suitable for dressing of the cutting blade 46 may be registered in the specifying part 52*d*.

The determination of whether or not the dressing board 1 disposed in the cutting apparatus 2 matches the kind of dressing board suitable for dressing of the cutting blade 46 is carried out in the determining part 52*c*. For example, the determining part 52*c* acquires the information relating to the properties of the dressing board 1 from the information registration part 52*a* and acquires the information relating to the kind of dressing board suitable for dressing from the specifying part 52*d*. If the determining part 52*c* determines that the properties of the dressing board 1 match the kind of dressing board suitable for dressing of the cutting blade 46, the control unit 52 carries out dressing of the cutting blade 46 by using the dressing board 1. On the other hand, if it is determined that the properties of the dressing board 1 do not match the kind of dressing board suitable for dressing of the cutting blade 46, this mismatch is informed to the operator or the like of the cutting apparatus 2. Information indicating the mismatch is displayed on a display part (not depicted) or the like of the cutting apparatus 2 to inform the mismatch to the operator (user) of the cutting apparatus 2. Alternatively, the cutting apparatus 2 may have an alarm buzzer and an alarm sound may be issued if it is determined that the dressing board 1 is improper.

When the dressing board 1 according to the present embodiment is used, information relating to the dressing board 1 can be acquired and dressing can be properly carried out even when the dressing board 1 is cut by a cutting blade.

The present invention is not limited to the description of the above-described embodiment and can be carried out with various changes. For example, in the above-described embodiment, the cutting apparatus 2 including the two cutting units 22 and the two dress tables 54 is described. However, the numbers of cutting units and dress tables included in the cutting apparatus 2 are not limited thereto and the cutting apparatus 2 may include one cutting unit and one dress table for example.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of using a dressing board in a cutting apparatus, where the cutting apparatus comprises a chuck table that holds a workpiece, a cutting unit that cuts the workpiece held by the chuck table by a cutting blade, a control unit that controls the chuck table and the cutting unit, and an imaging unit connected to the control unit, where the control unit includes a reading part that is connected to the imaging unit and is configured to read a barcode and a two-dimensional code, an information registration part, a specifying part, and a determining part, wherein the method includes:

reading, via the reading part, a barcode and a two-dimensional code that are possessed by a dressing board disposed in the cutting apparatus, registering, in the information registration part, identification information read from the barcode by the reading part and information relating to properties of the dressing board, read from the two-dimensional code, in association with each other, registering, using the specifying part, a kind of dressing board suitable for dressing of the cutting blade, determining, via the determining part, whether or not the properties of the dressing board included in the information relating to the properties read out from the information registration part based on the identification information read by the reading part match the kind of dressing board suitable for dressing of the cutting blade, registered in the specifying part, dressing the cutting blade with the dressing board such that the two-dimensional code is rendered unreadable by the reading part, wherein, after the identification information read from the barcode and the information relating to properties of the dressing board have been registered in association with each other, and after the two-dimensional code is rendered unreadable by the reading part:

the reading part sends, to the information registration part: (i) a signal indicating that the two-dimensional code cannot be read, and (ii) the identification information acquired by reading the bar code, and the information registration part: (i) acquires the information relating to properties of the dressing board that have been registered in association with the identification information sent by the reading part, and (ii) sends the acquired information relating to the properties of the dressing board to the determining part.

2. The method according to claim 1, wherein the cutting blade of the cutting unit and the dressing board are oriented with respect to each other such that a groove in the dressing board created by the cutting blade extends in a first direction and wherein the barcode includes a plurality of bars that each extend in a second direction, and where the second direction crosses the first direction.

3. The method according to claim 2, wherein the two-dimensional code is positioned with respect to the barcode such that a space extending in the first direction is defined therebetween.

* * * * *